United States Patent [19]

Echols

[11] Patent Number: 4,566,136

[45] Date of Patent: Jan. 28, 1986

[54] NURSING BLOUSE WITH HIDDEN OPENING

[76] Inventor: Sylvia S. Echols, 4414 Cannon Rd., Loganville, Ga. 30249

[21] Appl. No.: 522,321

[22] Filed: Aug. 12, 1983

[51] Int. Cl.[4] ..... A41D 1/20

[52] U.S. Cl. ..... 2/104

[58] Field of Search ..... 2/104; 128/460; 112/265.2

[56] References Cited

U.S. PATENT DOCUMENTS

| | | | |
|---|---|---|---|
| 890,614 | 6/1908 | Culver | 2/104 |
| 907,290 | 12/1908 | Rouff | 2/104 |
| 1,098,155 | 5/1914 | Knapp | 2/104 |
| 1,206,480 | 11/1916 | Stagg | 2/104 |
| 1,250,464 | 12/1917 | Janes | 2/104 |
| 1,309,269 | 7/1919 | Winnegradi | 2/104 |
| 2,911,650 | 11/1959 | Gerich | 2/104 |
| 3,002,478 | 10/1961 | Duchan | 112/265.2 |
| 3,425,420 | 2/1969 | Steinberger | 128/460 |
| 3,449,763 | 6/1969 | Grate | 2/104 |
| 4,004,294 | 1/1977 | Pinch | 2/104 |
| 4,031,566 | 6/1977 | Johnson | 2/104 |

*Primary Examiner*—Doris L. Troutman

*Attorney, Agent, or Firm*—Glenn K. Robbins

[57] ABSTRACT

A nursing blouse to provide breast concealment during nursing. The blouse has a front portion provided with an elongated opening adapted to expose the breast for nursing. A concealment flap or ruffle is connected to the blouse which extends along the opening and is of a sufficient width to extend over the opening to cover and conceal the breast while the infant is nursing. A zipper or slide fastener is provided to open and close the opening. By connection of the zipper strip to the underside of the blouse alongside the opening the blouse may be closed to butt the edges of the blouse along the opening to give the appearance of a seam or the like and conceal the zipper.

2 Claims, 10 Drawing Figures

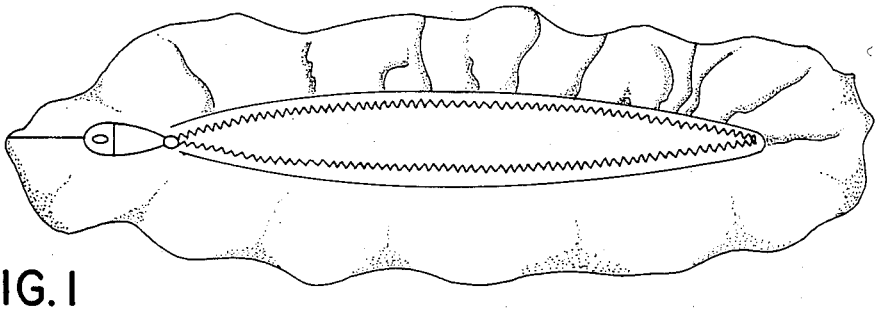
FIG. 1
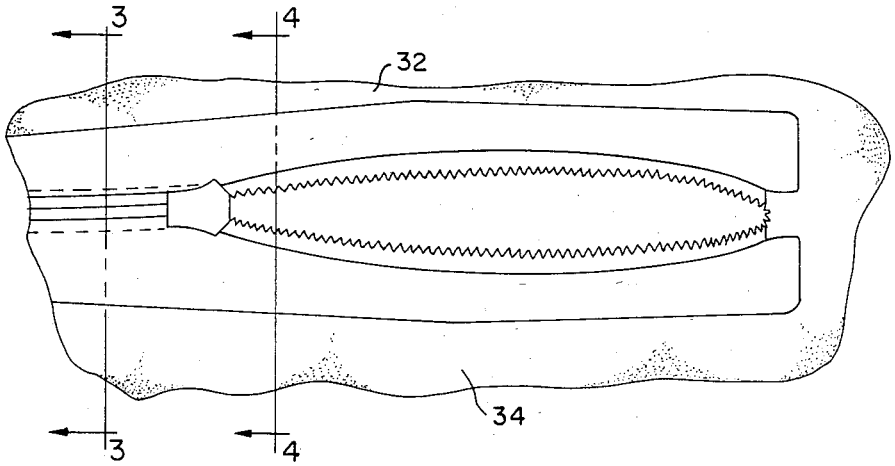
FIG. 2
FIG. 3
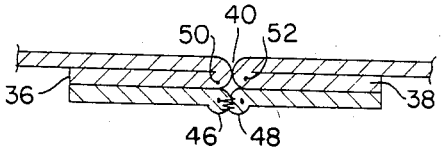
FIG. 4
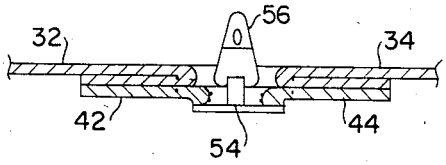

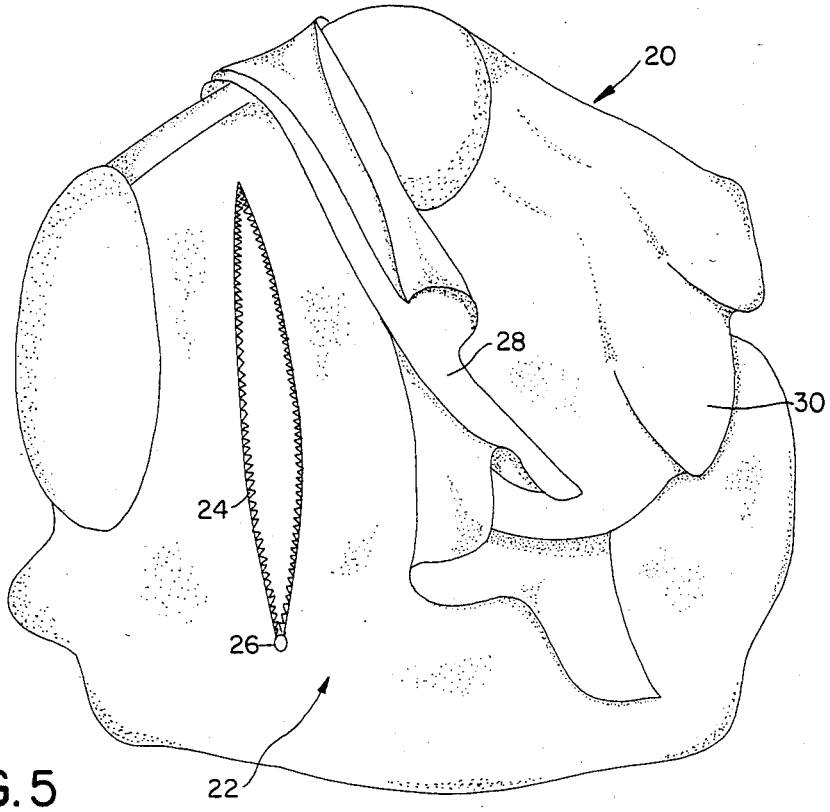
FIG. 5
FIG. 6
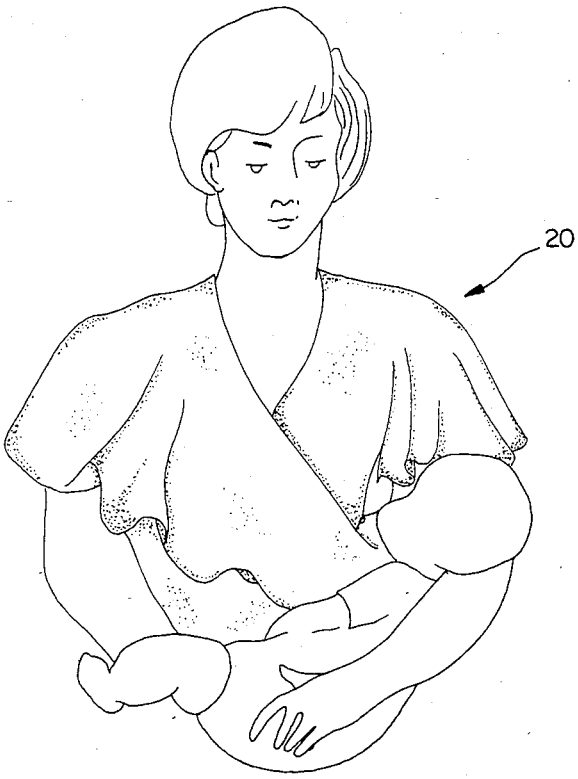

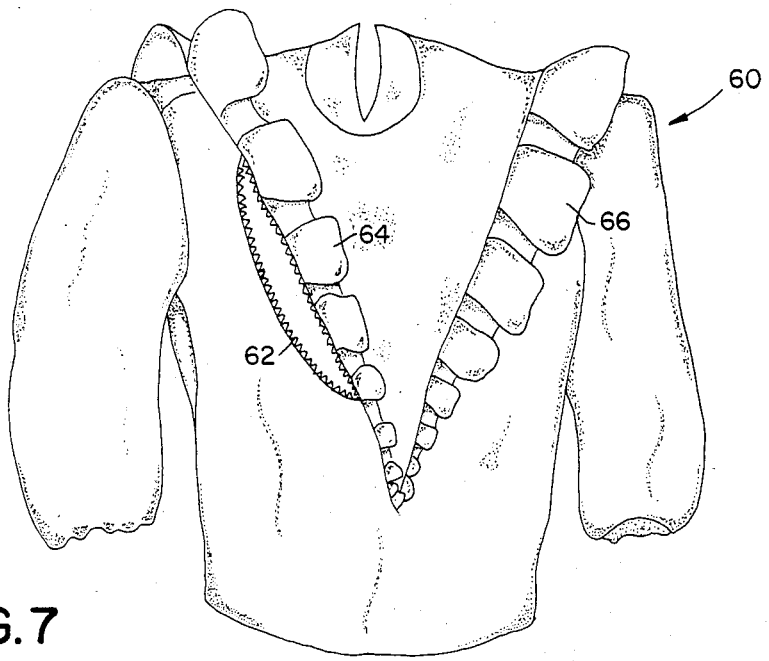
FIG. 7
FIG. 8
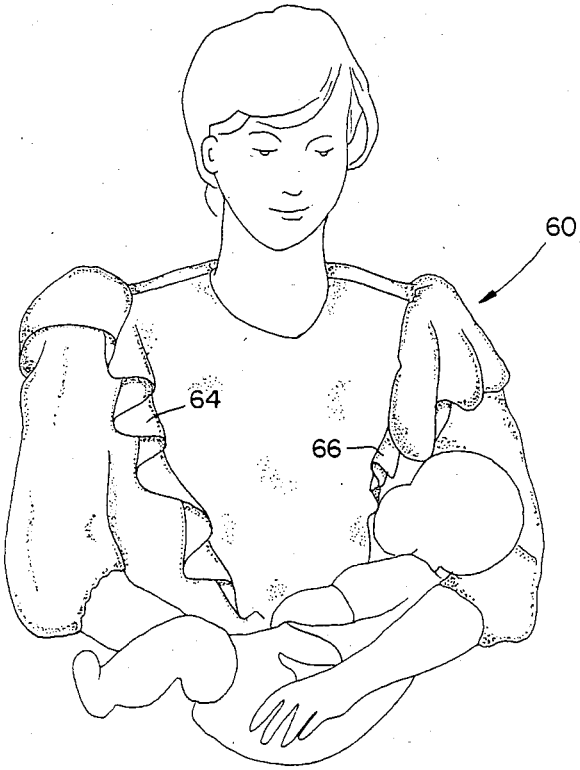

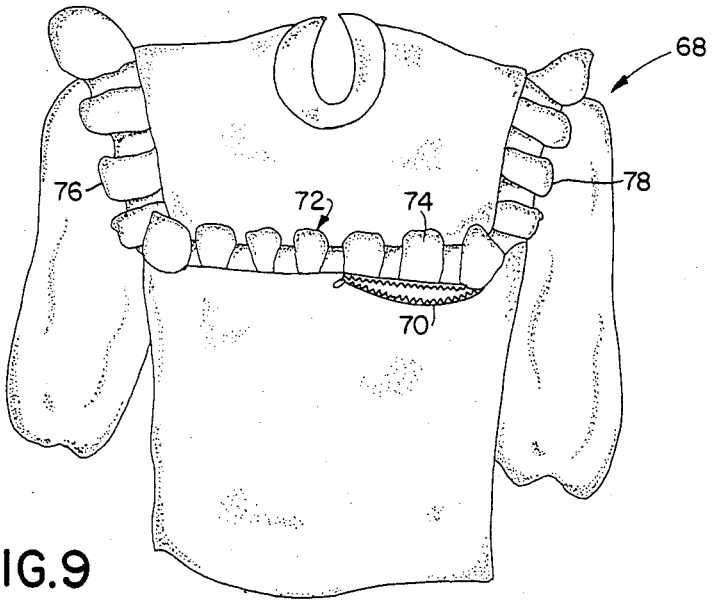
FIG.9
FIG.10
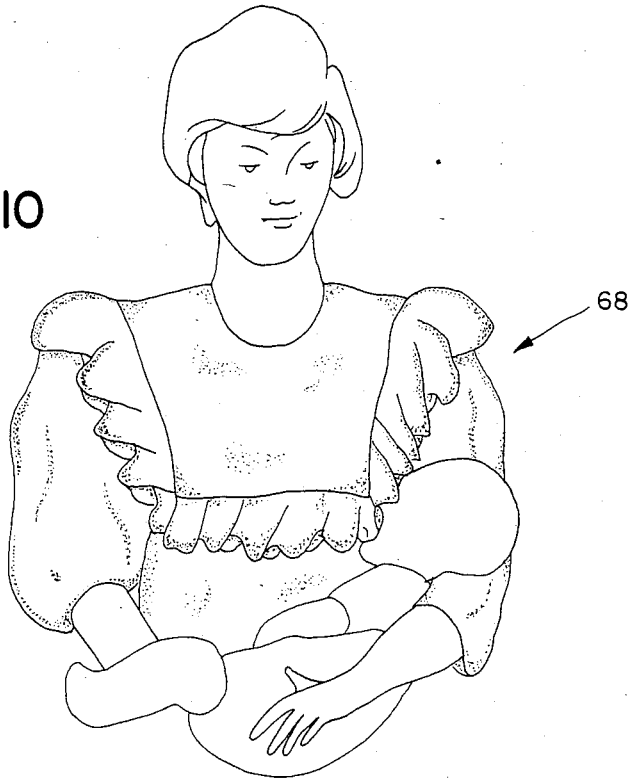

NURSING BLOUSE WITH HIDDEN OPENING

BACKGROUND OF THE INVENTION

In the past the nursing of infants in public has provided a sourse of difficulty for modest mothers. It is apparent that natural or breast feed nursing has long been desirable for the proper feeding and care of infants. Such nursing when carried out in the company of other individuals where the nursing mother does not have ready access to privacy has been difficult for the mother as well as for others in the area.

While blouses have been provided for nursing mothers that are provided with breast openings that enable the nursing operation to be carried out there has not been available a quick opening construction with concealment provisions to permit the nursing while covering and concealing the breast. Further, a natural appearing blouse that has no attention drawing features for the nursing has not been provided.

SUMMARY OF THE INVENTION

By means of this invention there has been provided a nursing blouse which may be worn by nursing mothers with complete modesty. The nursing operation is carried out with the infant craddled in the arms to provide a natural appearance with the breast covered and concealed by a concealment flap which extends over a zippered breast opening permitting breast feeding. The blouse provides a natural and stylish appearance lending itself to a variety of different designs to fit the taste of the user.

The blouse opening may be either in the form of a preferred vertical or diagonal elongated opening although horizontal or other configurations may also be employed. Preferably two openings are employed over each breast but a single opening may be used as desired.

The opening is constructed in a special fashion in order that when closed the closed edges take the appearance of a normal blouse seam to avoid drawing attention to the special construction and provide a neat and stylish appearance. The provision of a flap or ruffle on the front of the blouse over each of the openings further obscures the opening while providing an overlying cover over the opening when the blouse is opened for nursing.

Each of the blouse openings is adapted to be opened and closed by a zipper or slide fastener. The zipper is connected underneath the edges of the blouse in such a manner as to be totally obscured in the closed position by urging the blouse edges along the opening together in butting relation. This is accomplished by attaching the parallel zipper strips along the underside of the blouse along each side of the opening with the teeth of the zipper under the opposite edges of the blouse opening in such fashion that the zipper lock in the zipper closing or locking fashion causes the edges of the blouse opening to be drawn together as the zipper teeth are locked together. The closing of the blouse opening edges together is further enhanced by a fold of the blouse fabric together along the opening edge and attachment of the zipper strip along the fold. The double thickness of the blouse fabric at the opening edge facilitates the butting together of the fabric edges and the illusion of a closed seam.

The construction of the blouse nursing opening and covering flap or ruffle lends itself to fabrication of nursing blouses of various styles and designs. The construction can be simply and efficiently carried out in a wide variety of blouses at a modest cost of standard fabrics as desired. The finished nursing blouse is simply and effectively employed in the nursing operation while preserving the modesty of the mother and when not nursing the blouse may be worn as a normal blouse with no indication of its special purpose.

The above features are objects of this invention. Further objects will appear in the detailed description which follows and will be otherwise apparent to those skilled in the art.

For the purpose of example a preferred embodiment and modifications are shown. The drawing is for purpose of illustration only and the invention is not limited thereto.

IN THE DRAWING

FIG. 1 is a fragmentary top plan view of the nursing blouse opening with the hidden zipper;

FIG. 2 is a fragmentary bottom plan view of the hidden zipper opening;

FIG. 3 is a view in section taken on line 3—3 of FIG. 2 showing the connection of the hidden zipper to the underside of the blouse in the zipper closed position;

FIG. 4 is a view in section taken on line 4—4 of FIG. 2 showing the zipper open position;

FIG. 5 is a pictorial view showing the blouse with the right breast opening open and uncovered and the left breast blouse opening covered by a blouse flap;

FIG. 6 is a view similar to FIG. 5 but showing the right breast opening covered and a baby feeding through the left breast opening;

FIG. 7 is a pictorial view of a modified blouse showing a right breast opening open and uncovered and a right breast opening covered;

FIG. 8 is a view similar to FIG. 7 showing the right breast covered and a baby feeding through the left breast opening;

FIG. 9 is a pictorial view of a further modified blouse showing a horizontal right breast opening open and uncovered; and FIG. 10 is a view similar to FIG. 9 showing a baby feeding through the right breast opening.

DESCRIPTION OF THE INVENTION

The nursing blouse of this invention is generally designated by the reference numeral 20 in FIGS. 5 and 6. It is comprised simply of a front portion 22 and a vertically extending blouse portion opening 24 on the right breast portion of the blouse adapted to be opened and closed by a zipper 26. A flap or ruffle 28 connected to the blouse is shown pulled away from the opening but is of sufficient size to overlie the openings and cover the breast of the mother while nursing.

A second flap 30 extends over the left breast of the blouse and covers a second blouse opening (not shown) for the left breast.

The special construction of the blouse opening and affixation of the zipper or slide fastener is best shown in FIGS. 1, 2, 3 and 4.

The blouse opening is constructed by fashioning an elongated slot in the front blouse portion to form two blouse panels 32 and 34. These panels are folded over at the slit edge to form underlying marginal strips 36 and 38 respectively. When butted together as shown in FIG. 3 in the closed position a seam 40 is formed.

The zipper generally designated by the reference numeral 26 is connected to the underside of the blouse in order to be hidden from view when the blouse opening is closed. The zipper strips 42 and 44 having fastener lock teeth of nylon or the like 46 and 48. The strips are stitched to the fabric strips 36 and 38 by stitching 50 and 52 in such a manner that the teeth underlie the fabric folds. A zipper slide lock 54 slides on the zipper teeth and is adapted to lock and unlock the teeth in the usual fashion. While the zipper lock underlies the fabric a handle 56 is provided that may be operated from the top side of the blouse.

By the aforementioned construction the zipper underlies the outer portion of the blouse fabric with only the small handle fitting through the blouse in order that it may be rapidly and efficiently operated by the nursing mother. In the blouse opening closed position as shown in FIG. 3 the blouse edges are completely closed together and only the fabric seam 40 is visible and no stitching or other construction is shown.

A modified blouse 60 is shown in FIGS. 7 and 8. In this modification a diagonal blouse zippered opening 62 is shown on the right breast of the blouse with an overlying flap 64 shown which is adapted to overlie and cover the opening. A similar flap 66 is shown for the left breast which covers a diagonal zippered opening (not shown). The construction of the zippered openings is carried out in a similar manner to that described for the blouse of FIGS. 5 and 6 and particularly shown in FIGS. 1 through 4.

A further modification is shown by the reference numeral 68 in FIGS. 9 and 10. In this modification a horizontal zippered opening is shown at 70. A flap or ruffle 72 is shown in the uncovered position at a horizontal flap portion 74. Side portions 76 and 78 of the flap extend over the shoulder to illustrate a range of flap design that may be employed. The blouse opening and zipper affixation is effected in a similar manner as for the aforementioned blouses and particularly shown in FIGS. 1 through 4.

USE

The nursing blouse of this invention is simply and efficiently employed by nursing mothers in a fashion to preserve modesty by covering the breast in the nursing operation.

The blouse when not employed in nursing presents the appearance of a blouse of a design with flaps or ruffles which may be varied according to a desired style. With the nursing opening closed only the seam 40 is presented for viewing while the underlying blouse fold and zipper construction is hidden. The seam 40 where the blouse fabric folds are butted together provides the appearance of a conventional blouse seam and attracts no attention.

When nursing is desired for the blouse 20 of FIGS. 5 and 6 the mother simply cradles the baby as shown in FIG. 5 and, while ensuring that the flap covers the breast opening to be uncovered, operates the zipper to open the appropriate blouse opening to nurse the baby. The overlying flap permits the baby to be nursed while shielding the breast to ensure privacy in the nursing operation.

The modified blouse 60 of FIGS. 7 and 8 and blouse 68 of FIGS. 9 and 10 are employed in a similar manner as that just described. They show variations in the location of the blouse opening and flap or ruffle that may be employed to provide different designs or styles to fit the variations employed in the fashion industry while still providing the privacy afforded by the instant invention.

Various changes and modifications may be made within this invention as will be apparent to those skilled in the art. Such changes and modifications are within the scope and teaching of this invention as defined in the claims appended hereto.

What is claimed is:

1. A fabric nursing blouse for nursing mothers providing concealment for the breast in the nursing of an infant, said blouse having a front side with a breast panel having an elongated opening for exposing a breast for the nursing of the infant, a concealment flap connected to the front side of the blouse extending alongside of the opening and overlying the opening a sufficient extent to cover the breast while the infant is nursing through said opening and a zipper connected to an underside of said panel along said opening for opening and closing thereof, said breast panel opening in the closed position having opposite panel portions butted together to overlie and obsure said zipper, said opposite panel portions being each folded over at the blouse opening to provide an underlying fold strip and butted together at the aforementioned fold in the blouse opening closed position and the zipper being comprised of a pair of zipper strips adapted to be locked and unlocked together, said zipper strips being connected to said underlying fold strips, said zipper strips being provided with interlocking teeth on opposite sides of the zipper strips adapted to be locked together and unlocked and said teeth underlying and being connected to the folded edges of said panels and fold strips.

2. The nursing blouse of claim 1 in which said strips are provided with a slide zipper lock which is slidable along said zipper strips to lock and unlock said teeth, said zipper lock completely underlying the blouse panels and having a handle extending thereabove for manual operation by the nursing mother.

* * * * *